US005147196A

United States Patent [19]

Adly

[11] Patent Number: 5,147,196

[45] Date of Patent: Sep. 15, 1992

[54] MACHINE FOR MAKING CONCRETE PIPES

[75] Inventor: Tarek A. Adly, Nashua, Iowa

[73] Assignee: International Pipe Machinery Corporation, Sioux City, Iowa

[21] Appl. No.: 435,192

[22] Filed: Nov. 13, 1989

[51] Int. Cl.[5] ..... B28B 21/28

[52] U.S. Cl. ..... 425/145; 425/262; 425/424; 425/427; 425/456; 425/457

[58] Field of Search ..... 425/145, 262, 427, 457, 425/135, 426, 147, 162, 456, 424, 425; 264/70-72

[56] References Cited

U.S. PATENT DOCUMENTS

| | | | |
|---|---|---|---|
| Re. 28,902 | 7/1976 | Trautner et al. | 425/262 |
| 2,926,411 | 3/1960 | Steiro | 425/421 X |
| 3,095,628 | 7/1963 | Norton et al. | 425/262 |
| 3,141,222 | 7/1964 | Steiro | 425/262 X |
| 3,551,968 | 1/1971 | Fosse et al. | 425/431 |
| 3,655,842 | 4/1972 | Trautner | 425/117 |
| 3,662,437 | 5/1972 | Long, Sr. | 425/262 X |
| 3,752,626 | 8/1973 | Trautner et al. | 425/262 |
| 3,829,268 | 8/1974 | Gill | 425/262 |
| 3,922,133 | 11/1975 | Crawford et al. | 425/262 |
| 3,948,354 | 4/1976 | Fosse et al. | 425/432 X |
| 4,118,165 | 10/1978 | Christian | 425/262 |
| 4,131,408 | 12/1978 | Schulster | 425/410 |
| 4,253,814 | 3/1981 | Christian | 425/150 |
| 4,340,553 | 7/1982 | Fosse | 264/40.7 |
| 4,406,605 | 9/1983 | Hand | 425/145 |
| 4,639,342 | 1/1987 | Adly | 264/40.1 |
| 4,690,631 | 9/1987 | Haddy | 425/262 |
| 4,957,424 | 9/1990 | Mitchell et al. | 425/145 |

*Primary Examiner*—Richard L. Chiesa

*Attorney, Agent, or Firm*—Burd, Bartz & Gutenkauf

[57] ABSTRACT

A concrete pipe making machine having a pair of combined roller head and vibrating core assemblies are used with two molds to prepack and vibrate concrete within the molds to simultaneously produce two concrete pipes. A controller is programmed in response to packing forces of the packerheads to control conveyors that discharge concrete into the molds and the lift speed of the packerhead and core assemblies to produce concrete pipes having uniform density throughout the length of the concrete pipes.

31 Claims, 6 Drawing Sheets

FIG. 1
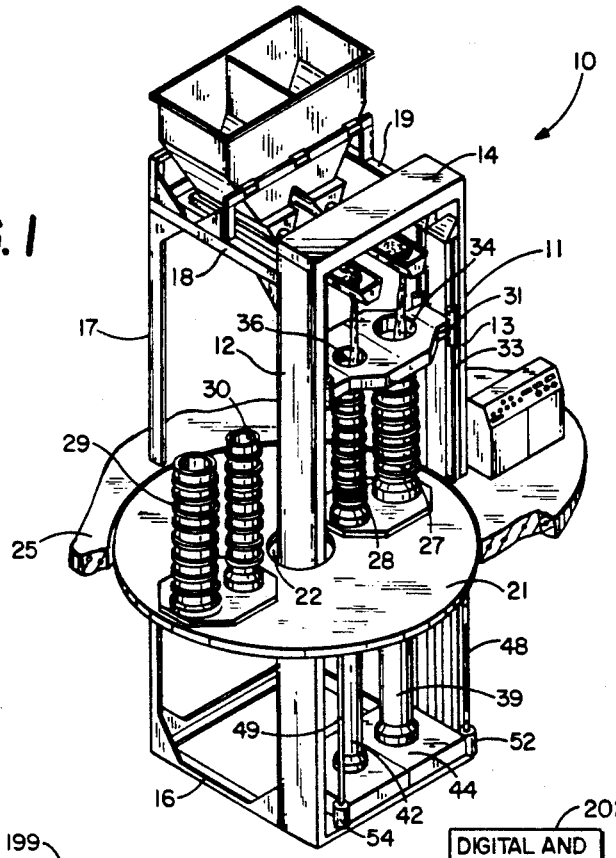
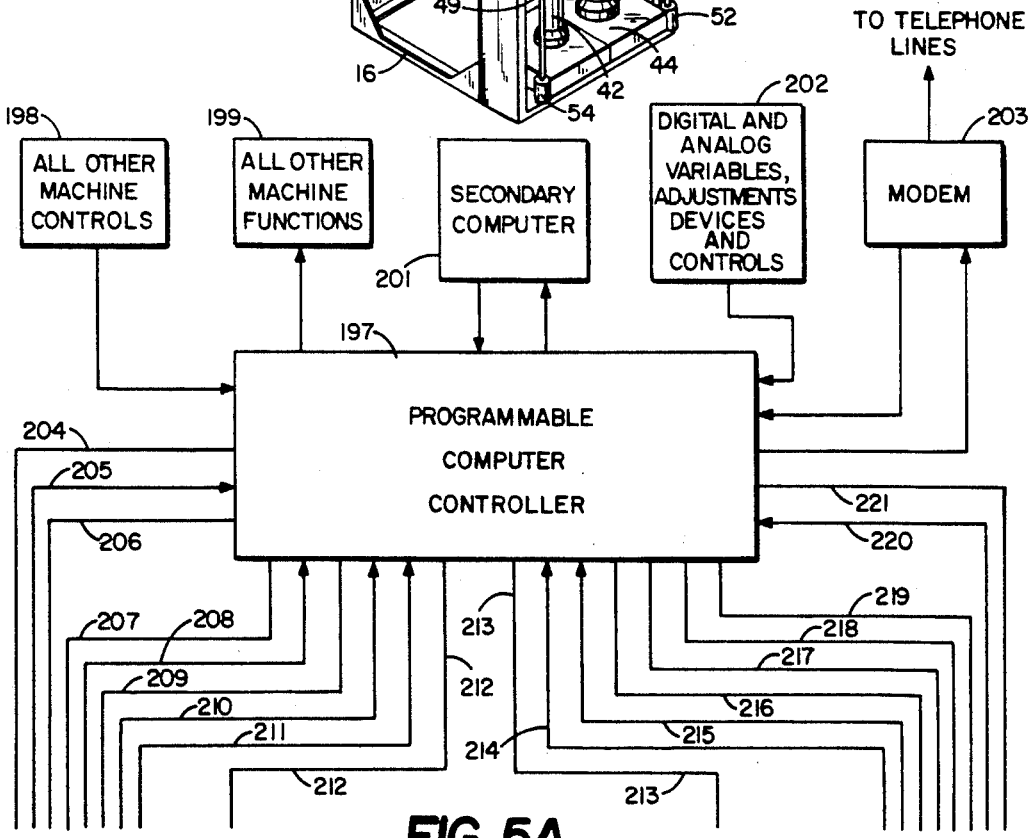
FIG. 5A

MACHINE FOR MAKING CONCRETE PIPES

TECHNICAL FIELD

The invention is in the field of concrete product making machines and controls for operating the machines. The particular concrete product making machine uses a combined packerhead and vibration process to make two concrete pipes. This machine has packer heads that prepack the concrete and cores that are vibrated as they move up into molds to form and densify the prepacked concrete into two pipes.

BACKGROUND OF INVENTION

There are two general types of concrete pipe making machines known as packerhead and vibrating core machines. Packerhead concrete pipe making machines have packerheads with rollers that are moved along an annular path and up into molds to form concrete pipes. An example of a packerhead concete pipe making machine having a packerhead with elastic rollers is disclosed by Haddy in U.S. Pat. No. 4,690,631. The packerhead process of making concrete pipes is fast in operation and produces concrete pipes having smooth outside and inside finishes. Packerhead concrete pipe making machines have been proposed to simultanously make two concrete pipes to increase pipe production. These machines require constant operator attention to ensure a supply of concrete above each packerhead necessary to produce two concrete pipes. An example of a packerhead concrete pipe making machine for simultaneously making two concrete pipes is disclosed by Christian in U.S. Pat. No. 4,118,165. Vibrating core concrete pipe making machines have generally cylindrical cores and vibrators mounted on the cores. The cores are moved up into molds to form concrete pipes. The vibrators vibrate the cores to consolidate and densify the concrete in the molds during the forming of the pipes. An example of a vibrating core concrete pipe making machine is shown by Fosse et al in U.S. Pat. No. 3,948,354.

The vibration process is a relatively slow method of making concrete pipes as compared to the packerhead process. However, the vibration process produces denser pipes and does not twist the reinforcing cages within the pipes. The outside finish of pipes made by the vibration process is not smooth due to a tendancy of air pockets to collect between the outside walls of the pipes and the molds.

PRIOR ART

Steiro in U.S. Pat. Nos. 2,926,411 and 3,141,222 discloses concrete pipe making machines that have cores located within cylindrical molds. When the cores are up in the molds, concrete is discharged into the annular spaces between the cores and molds. A distributor mounted on top of the core is used in U.S. Pat. No. 3,141,222 to move concrete into the annular space between the core and mold. The core is reciprocated and vibrated to trowel the inner surface of the pipe and settle the concrete in the mold. Norton et al in U.S. Pat. No. 3,095,628; Trauter in U.S. Pat. No. 3,655,842 and Christian in U.S. Pat. No. 4,253,814 disclose concrete pipe making machines having cores and packerheads that are concurrently used to make concrete pipe. The packerheads are connected to lift structures located above the molds and are rotated with power units mounted on these structures. The cores are moved up into the molds with separate lift cylinders. Fosse et al in U.S. Pat. No. 3,948,354 and Schulster in U.S. Pat. No. 4,131,408 disclosed concrete pipe making machines having vibrating cores that move up into molds to form the pipe and densify the concrete. Distributor arms rotated above the cores move concrete into the annular spaces between the cores and mold as the cores are moved up into the molds.

SUMMARY OF INVENTION

The machine for making concrete product, such as a concrete pipe, of the invention utilizes concurrent packerhead and vibration processes is to make two concrete pipes. The machine has a turntable supporting a pair of upright molds. Conveyors discharge concrete into the molds onto concrete forming apparatus. Each concrete forming apparatus has a generally upright core supporting a vibrator used to vibrate the core to subject concrete in the mold around the core to vibrations which densify the concrete. The cores are supported on a platform or table which is moved to concurrently advance both cores into the molds to form two concrete pipes. A rotating packerhead assembly mounted on top of each core functions to prepack the concrete into generally cylindrical configuration before it is subjected to the vibrations generated by the cores. Separate motors are used to drive the packerheads as they advance with the cores into the molds. The prepacking of the concrete by the rotating packerheads produces pipes having a smooth finish on their outside surfaces as the concrete is forced against the molds to preclude the entrapement of air packets adjacent the molds. The prepacking of the concrete before it is subjected to the vibrations of the cores reduces the amount of time required to vibrate the concrete to produce finished concrete pipes. The combination of the packerhead and vibrating processes employed in the machine for making pipe produces concrete pipe that has substantially the same density as pipes made on vibration machines with the same quality inside and outside surface finish as concrete pipes made on a conventional packerhead machine. A machine control has a computer controller that responds to the concrete packing force of each packerhead to control the operation of the conveyors and the lift speed of the platform to maintain a supply of concrete in each mold to make two concrete pipes.

A preferred embodiment of the machine for making cylindrical concrete pipes uses a pair of upright molds. Each mold has a generally cylindrical mold side wall surrounding a mold chamber. The molds have the same length. The diameters of the molds can vary so that two sizes of concrete pipes can be made at the same time. This eliminates machine down time to change cores and molds for different size pipes. A generally cylindrical reinforcing cage can be located within each mold chamber adjacent the mold side wall to provide reinforcement for the finished concrete pipe. A turntable having an opening supports the molds in general vertical alignment with the openings. Two concrete pipes are formed with packerhead and vibrating core assemblies that advance into the mold chambers. The assemblies are supported on a platform that is moved with hydraulic cylinders to selectively advance and retract the assemblies into and out of the molds. Conveyors located above the molds operate to discharge concrete into the mold chambers above the packerhead and vibrating core assemblies. The packerheads are driven with separate motors to distribute and prepack the concrete before the concrete is subjected to the forming and densification action of the vibrating cores. Each core has a cylindrical side wall that supports a vibrator operable to vibrate the side wall and thereby subject the concrete around the core to vibrations. The vibrations enhances the densification of the concrete that has been prepacked by the rotating packerheads. Each packerhead has a plurality of circumferentially arranged rollers that are rotatably mounted for rotation above separate axes generally parallel to the upright axis of the core. The rollers have outer circumferential portions that move along a circular path having a diameter smaller than the diameter of the core side wall whereby the rollers prepack the concrete adjacent the mold to a thickness greater than thickness of the concrete in the space between the core side wall and the mold as the rollers move along the circular path.

The machine for making concrete pipes has controls regulating the operation of the conveyors and lift speed of the platform in a manner to concurrently produce two concrete pipes. These controls have electric drive motors and electric power transducers for sensing the power used by the motors to turning the packerheads and generating a signals representing the sense power. Alternatively, a fluid pressure transducer can be used to sense the power used to turn the packerhead and provide a signal representative of the packing force of the packerhead. A computer controller is programmed to be responsive to the signals to control the speed of operation of the conveyers thereby control the rate at which concrete is discharged into each mold chamber. When the amount of concrete above a rotating packer head increases, the amount of torque required to rotate the packerhead increases. The increase in torque is sensed with either an electrical or pressure transducer which generates a signal acceptable to the computer controller. The controller will then actuate the drive system for the conveyor to slow the speed of operation of the conveyor and thereby reduce the amount of concrete that is discharged into the mold chamber. When the amount of concrete above a rotating packerhead decreases, the speed of the conveyer associated with this packerhead increases as the amount of torque or power required to rotate the packerhead decreases. The decrease in the torque to rotate the packerhead is sensed by the transducer which signals the controller which in turn signals the conveyor drive to increase the speed of operation of the conveyer and thereby increase the amount of concrete that is discharged into the mold. In this manner, the levels of the concrete above the rotating packerheads are maintained so that the packerheads have substantially constant packing forces on the concrete in the molds.

The vibrating core and rotating packerhead assemblies are moved up into the mold chambers at a selected speed that is responsive to the signals representing the sense power of the motors or hydraulic fluid pressure for turning the packerheads. Both sensed signals are separately used to adjust the speed of movement of the core and packerhead assemblies up into the molds. The adjustment of the speeds of the conveyors and lift speed of the packerhead and core assemblies operate together to maintain substantially constant packing forces on the concrete being prepacked by the packerheads. The power lift for the packerhead and core assemblies utilizes one or more hydraulic cylinders to vertically advance the core and packerhead assemblies into their respective molds and retract them from the molds. Hydraulic fluid under pressure is supplied to the cylinders with a pump controlled with a valve. The operation of the valve is controlled with the computer controller that utilizes the signals representative of the sense power used by the motors for turning the packerheads. The vibrators mounted on the cores have motors that operates the vibrating structures at selected speeds to vary the vibrations that are generated. A control connected to the motors operates to increase the speed of the vibrator motors as the cores move up into the mold chambers. This increases the vibrations which are partially dampened by the mass of the concrete surrounding the cores as the length of the pipes increase.

A water dispensing system is used to maintain the moisture content of the concrete discharged by the conveyors into the molds. Moisture sensors are located in the hoppers storing concrete associated with the conveyors. The signals from the sensors are used by the computer controller to operate valves that control the flow of water into the top of the molds as the concrete is discharged by the conveyors into the molds. The rotating packerheads integrate the water and concrete and pre-pack that concrete around the packerhead. The core as it moves up into the mold subjects the concrete to vibrations which enhances the densification of the concrete around the core.

BRIEF DESCRIPTION OF THE DRAWING

FIG. 1 is a perspective view of a packerhead and vibrating core concrete pipe making machine for simultaneously making a pair of concrete pipes equipped with a control system for operating the machine;

FIGS. 5A, 5B, and 5C is a diagrammatic view of the concrete pipe making machine of FIG. 1 and the hydraulic and computer control system therefor.

DETAILED DESCRIPTION OF THE PREFERRED EMBODIMENT

Figure 2:
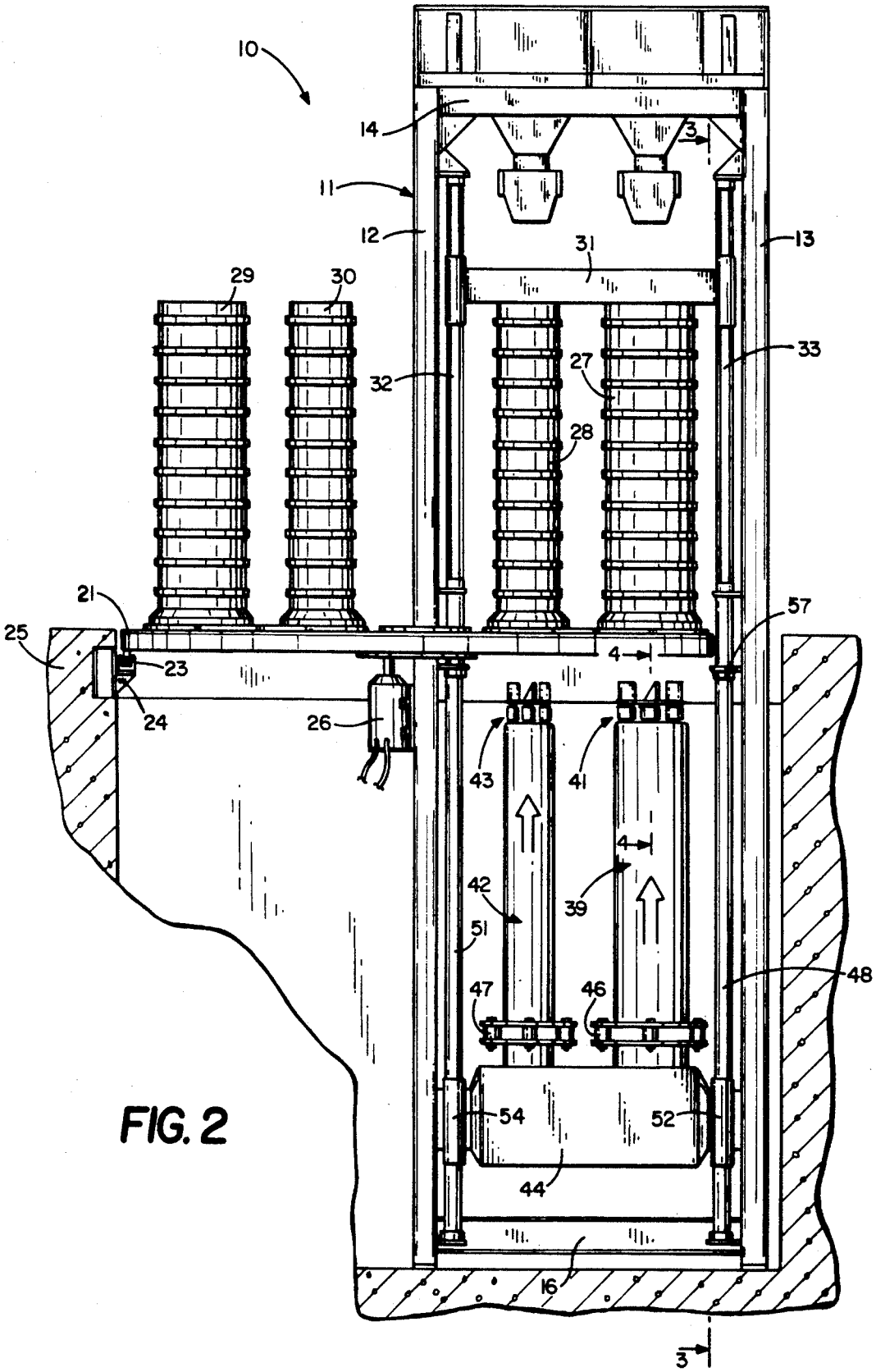
FIG. 2 is a front elevational view of the concrete pipe making machine of FIG. 1.

Referring to FIG. 1 there is shown the concrete pipe making machine of the invention indicated generally at 10 for the simultaneaously making a pair of concrete pipes. Machine 10 uses a combined packerhead prepacking and core vibration process to currently make two concrete pipes. Machine 10 has an upright frame 11 including upright front members 12 and 13 joined with a cross beam 14. Members 12 and 13 are supported on a base 16. The back of frame 10 has upright rear members 17 that are joined to front members 12 and 13 with top beams 18 and 19. A turntable 21 has a center hole 22 accommodating frame member 12. As shown in FIG. 2, rollers 23 mounted on the outer peripheral portion of turntable 21 ride in a circular track 24 mounted in a stationary support or floor 25. A drive motor 26 is operably connected to turntable 21 to index the turntable to locate a first pair of molds 27 and 28 in pipe making positions. A second pair of molds 29 and 30 are shown in the off bearing position on turntable 21. Molds 27 and 28 are upright cylindrical jackets having cylindrical upright walls that shape the outside surface of the concrete pipes. As shown in FIG. 2, mold 27 is larger in diameter than mold 28. This allows the machine to simultaneously make two different sized concrete pipes. The machine 10 can accommodate molds having the same diameters to simultaneously produce identical sized concrete pipes.

Figure 5B:
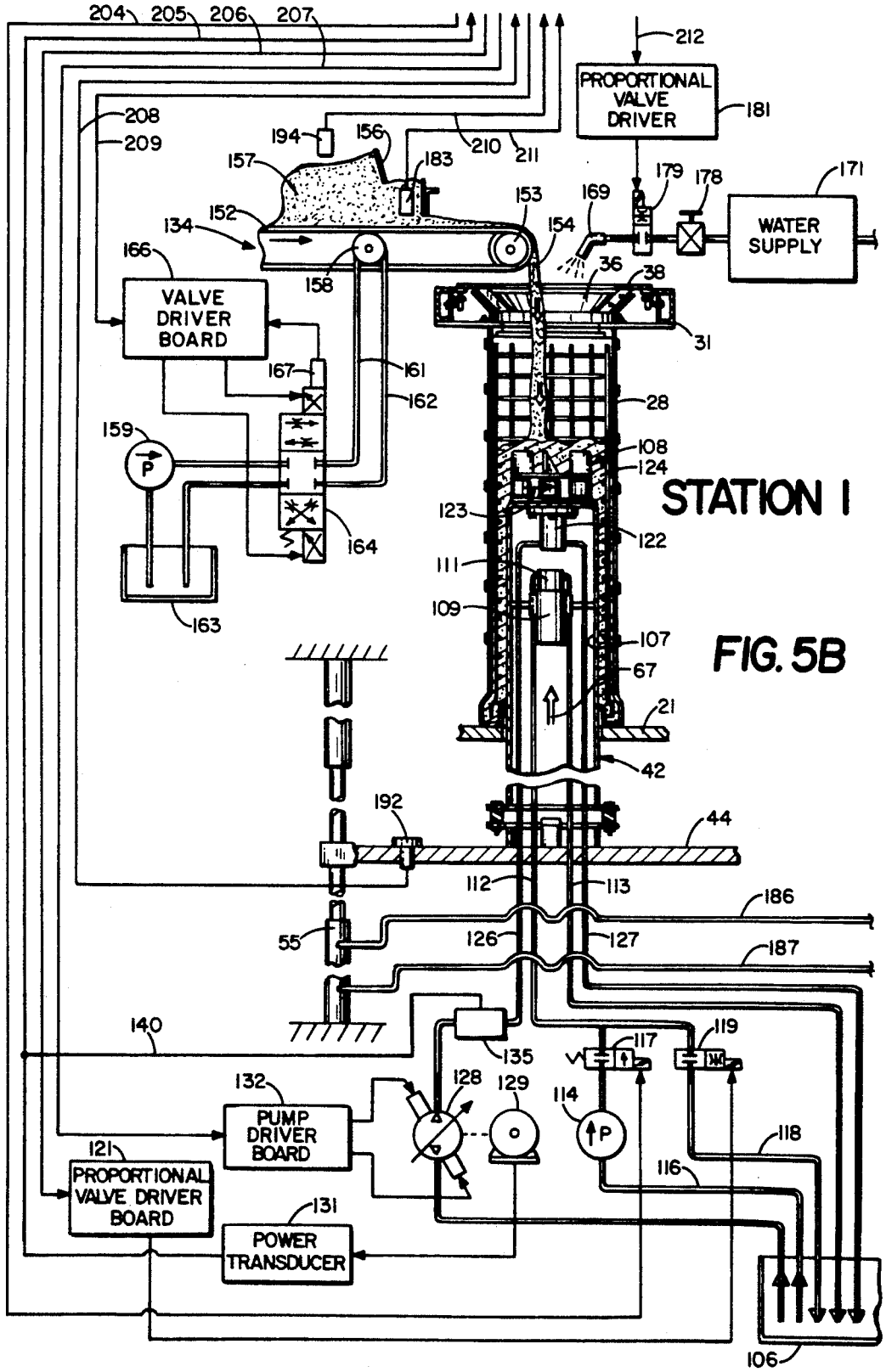
Figure 5C:
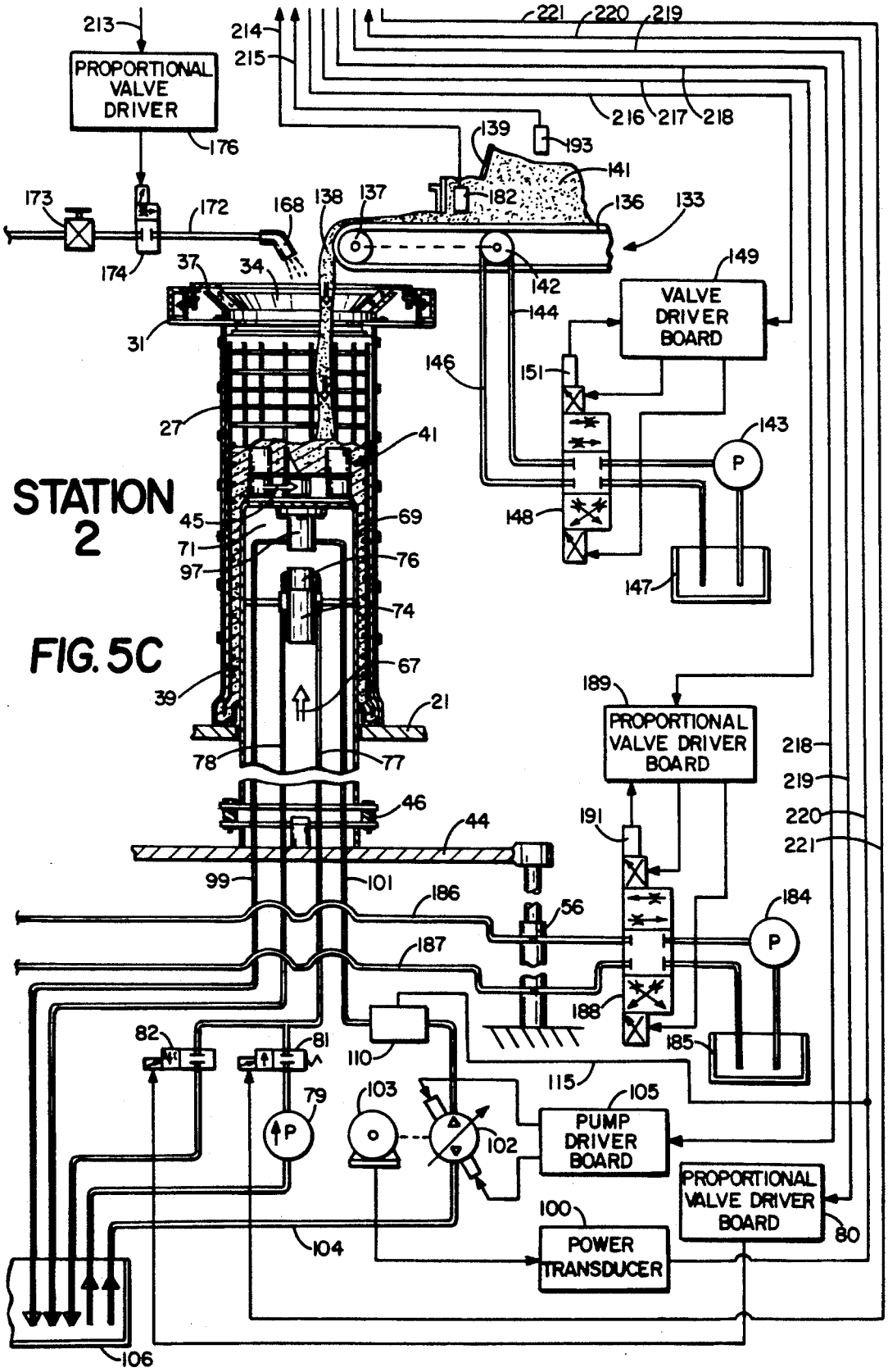

A top table or concrete feeding device 31 is located over molds 27 and 28. Table 31 is mounted for vertical movement on the pair of upright guides 32 and 33. Hydraulic cylinders (not shown) attached to opposite ends of table 31 function to raise and lower table 31. As shown in FIG. 1, table 31 has a pair of openings 34 and 35 to allow concrete to flow into the mold chambers of molds 27 and 28. Top table 31 has concrete feeding devices 37 and 38 as shown in FIGS. 5B and 5C for returning excess concrete that is moved up onto top table 31 during the formation of the pipes back into the mold chambers. Concrete feeding devices 37 and 38 have wiper blades that are rotatable to push concrete back into the mold chambers. An example of a concrete feeding device is disclosed by Fosse et al in U.S. Pat. No. 3,551,968, incorporated herein by reference.

Figure 3:
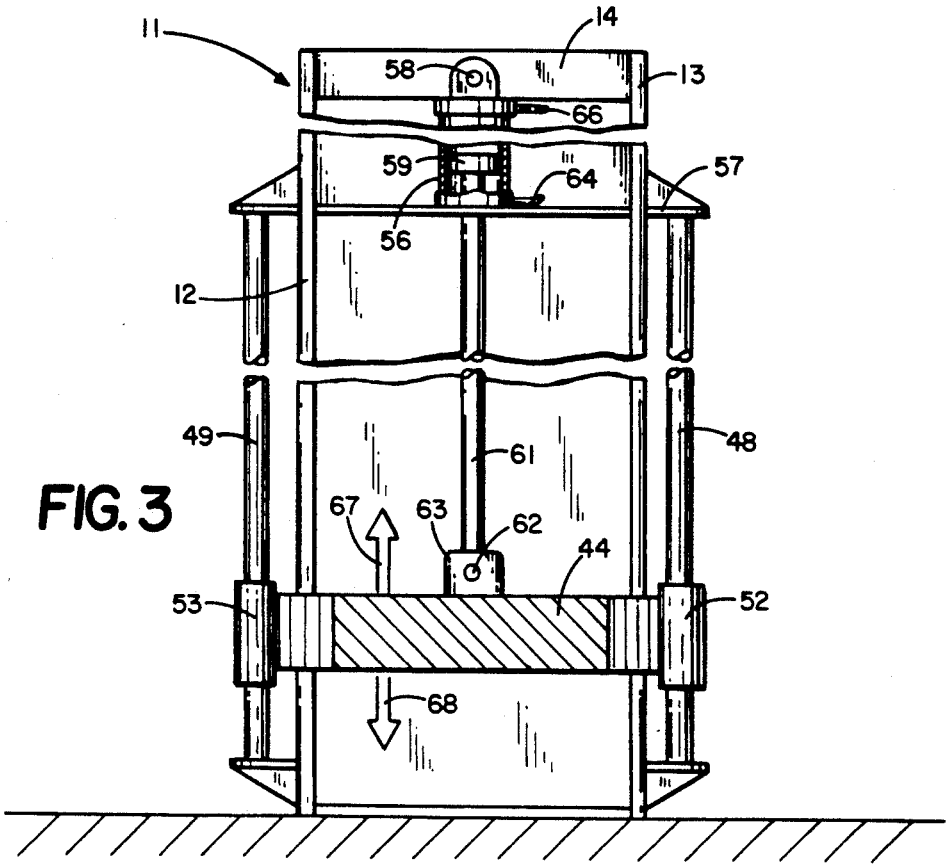
FIGS. 3 is a foreshortened sectional view taken along the line 3—3 of FIG. 2.

Returning to FIG. 2, a pair of cylindrical upright cores 39 and 42 are located below turntable 21. A first packerhead 41 is mounted on top of core 39. A second packerhead 43 is mounted on top of core 42. The bottom end of each core 39 and 42 is mounted on generally horizontal table or platform 44. Resilient pads 46 and 47 interpose between platform 44 and cores 39 and 42 minimize the transfer of vibrations from cores 39 and 42 to platform 44. Platform 44 is located between upright guide posts 48, 49 and 51. Opposite ends of posts 48, 49 are secured to frame member 13. Opposite ends of guide posts 51 are secured to the frame 12. As shown in FIG. 3, sleeves 52 and 53 secured to platform 44 are slideably mounted on posts 48 and 49. Similar sleeves 54 are slideably mounted on upright guide posts 51.

Linear actuators connected to platform 44 are used to selectively raise and lower the platform and thereby move the packerheads 41 and 43 along with cores 39 and 42 associated therewith up into molds 27 and 28 and retract them from the molds to the position shown in FIG. 2. The linear actuators are double acting hydraulic cylinders 56 that are connected to frames 12 and 13 on opposite sides of platform 44. An example of a hydraulic cylinder is as shown in FIG. 3. Hydraulic cylinder 56 is mounted on a frame support 57 and secured to top cross beam 14 with a pin 58. Cylinder 56 has a piston 59 secured to a downwardly directed piston rods 61. The lower end of piston rod 61 is secured with a pin 62 to ear 63 secured to platform 44. Hydraulic fluid under pressure is supplied to opposite ends of cylinder 56 through lines or hoses 64 and 66 to move piston 59 in cylinder 56 thereby move platform 44. The hydraulic cylinders 55 and 56 is used to selectively move platform 44 in up and down directions as indicated by arrows 67 and 68 during the operation of the machine to concurrently make a pair of concrete pipes.

Figure 4:
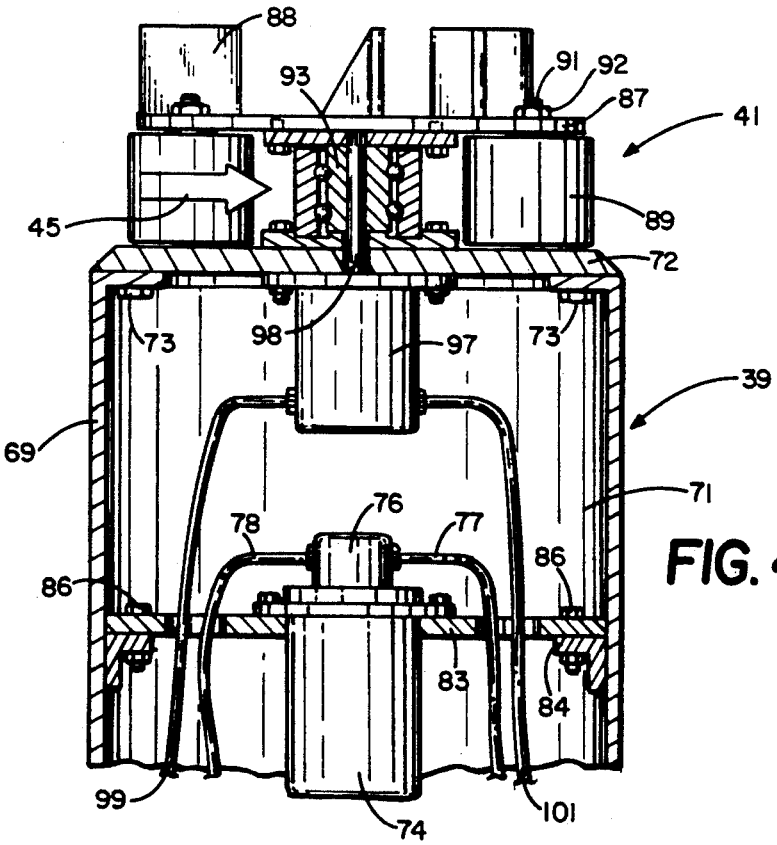
FIG. 4 is an enlarged sectional view taken along the line 4—4 of FIG. 2.

As shown in FIG. 4, core 39 has a cylindrical wall 69 surrounding an internal chamber 71. The top of core 69 has a top plate or wall 72 secured to side wall 69 with a plurality of bolts 73. A vibrator 74 is located in chamber 71. An example of a vibrator for a core of a concrete pipe making machine is shown by Fosse and Montgomery in U.S. Pat. No. 3,948,354 incorporated herein by reference. Vibrator 74 has a hydraulic fluid motor 76 that operates the vibrating components of the vibrator. Fluid carrying lines or hoses 77 and 78 supply hydraulic fluid under pressure to the motor 76 supplied by pump 79 connected to the line 77 and 78. Solenoid operated valves 81 and 82 control the flow of fluid to line 77 and thereby control the speed of operation of vibrator 74. As shown in FIG. 4, vibrator 74 is mounted on a flat plate or base 83 secured to brackets 84 with the bolts 86. Brackets 84 are attached to the inside portions of the cylindrical side wall 69 whereby the vibrations generated by vibrator 74 are transmitted to cylindrical side wall 69.

Roller head 41 has a generally horizontal circular plate 87 carrying a plurality of upwardly directed blades or fins 88 for moving concrete in a regular outward direction adjacent the mold side wall. A plurality of curcumferentially spaced rollers 89 are located below plate 87. The rollers 89 are mounted on generally upright axles 91 that are secured to plate 87 with nuts 92. Rollers 89 can be provided with resilient sleeves to insure the rotation of the rollers during the turning of packerhead 41. An example of a packerhead with rollers having elastic sleeves are shown by Haddy in U.S. Pat. No. 4,690,631, incorporated herein by reference. Each roller can have outer sleeves made of metal, ultra high molecular polyethyene plastic, ceramics, and like wear resistant materials. Packerhead 41 has four circumferentially spaced rollers 89 having outer peripheral portions that follow a circumferential path having a diameter less then the outside diameter of the cylinderical side wall 69 or core 39. The rollers work and prepack the concrete above core 69. As shown in FIG. 5C, the concrete around packerhead 41 in the prepack annular area has a thickness that is greater than the wall thickness of the concrete pipe around core 39. This aids core 39 to compact and densify the concrete during the forming of the concrete pipe. A hub 93 secured to the bottom of plate 87 extends into a sleeve 94 secured to top plate 72 of core 39. Hub 93 is rotatably mounted on sleeve 94 secured to top plate 72 of core 39. Hub 93 is rotatably mounted on sleeve 94 and is turned in the direction of arrow 45 with a hydraulic motor 97. Hydraulic motor 97 has an upwardly directed drive shaft located in driving relationship with hub 93. Hydraulic fluid carrying lines or hoses 99 and 101 carry hydraulic fluid under pressure to and from motor 97 to operate motor 97 and rotate packerhead 41 to prepack the concrete in mold 27.

Hydraulic fluid under pressure is supplied to motor 97 with a pump 102 connected to line 101. An electric motor 103 drives pump 102 which is supplied with hydraulic fluid through a line 104 leading to a tank of sump 106. Line 99 returns the hydraulic fluid back to tank 106. Motor 103 is wired to power transducer 100 that senses the electric power used by motor 103 to drive pump 102. The signal representing the sensed power is fed to computer controller 197 via line 220. This signal represents the packing force of packerhead 41 utilized by controller 197 to control conveyor 133 and core lift cylinders 55 and 56 during the forming of a concrete pipe in mold 27. Alternatively, a hydraulic fluid pressure transducer 110 located in hydraulic fluid line 101 senses the pressure of the hydraulic fluid generated by pump 102 and establishes a signal proportional to the pressure. This signal fed to controller 197 via lines 115 and 220 also represents the packing force of packerhead 41 which is used by controller 197 to control the operation of the machine. When pressure transducer 110 is used to sense the packing force of packerhead 41, motor 103 can be used to drive two pumps, such as pumps 79 and 103. The packing force signal is converted to a 0–10 volt signal for use by controller 197. The pressure transducer 110 has a sensing element that converts pressure into analog signals which are acceptable to the program of controller 197.

Referring to FIG. 5B, vibrating core 42 has an upright cylincrical wall 107 surrounding a chamber accomodating a vibrator 109. A hydraulic motor 111 mounted on vibrator 109 operates the vibrator to generate vibrations in wall 107 thereby vibrate the concrete pipe in mold 28. A packerhead 108 is mounted on top of core 42 to prepack the concrete in area 124 surrounding packerhead 108. Packerhead 108 has the same structure as packerhead 41 with a smaller diameter to accomodate the smaller mold 28.

Packerheads 41 and 43 can be counter rotating packerheads having roller assemblies that are driven in opposite circumferential directions. Examples of counter rotating packerheads are disclosed by Mitchell and Fosse in U.S. patent application Ser. No. 322,175, incorporated hereby by reference.

Lines 112 and 113 are connected to motor 111 to supply the motor with hydraulic under pressure from a pump 114. The pump 114 draws hydraulic fluid from tank 106 through a line 116 discharges the fluid through an on/off valve 117. The line 112 is connected to a bypass line 118 that leads back to tank 106. A proportional valve 119 is located in line 118 that leads back to tank 106. A proportional valve 119 is located in line 118 to control the flow of hydraulic fluid to vibrator motor 111 and thereby control the frequency and amplitude of the vibrations that are generated by vibrator 109. The solinoid of valve 119 is wired to a proportional valve driver board 121. Proportional valve driver boards 80 and 121 are connected to solenoids of valves 82 and 119 and the programmable computer controller 197 of the control system of the machine. Driver boards 80 and 121 control valves 82 and 119 in response to command signals from controller 197.

Packerhead 108 is driven in the direction of arrow 123 above core 42 with a hydraulic motor 122. Motor 122 is located within core 42 and operates to rotate packerhead 108 and sense the packing force required to prepack the concrete in annular space 124. Hydraulic fluid carrying lines 127 and 128 are connected to motor 122 and a variable output pump 128. An electric motor 129 drives motor 128. Motor 129 is wired to power transducer 131 that senses the power used by motor 129 to drive pump 128. The signal representing the sensed power is fed to computer controller 197 via line 205. This signal represents the packing force of packerhead 108 utilized by controller 197 to control conveyor 134 and core lift cylinders 55 and 56 during the forming of a concrete pipe in mold 28. Alternatively, a hydraulic fluid pressure transducer 135 located in hydraulic fluid line 126 senses that pressure of the hydraulic fluid generated by pump 102 and establishes a signal proportional to the pressure. This signal fed to controller 197 via lines 140 and 205 also represents the packing force of packerhead 108 which is used by controller 197 to control the operation of the machine. When pressure transducer 135 is used to sense the packing force of packerhead 108, motor 129 can be used to drive two pumps, such as pumps 114 and 128. The packing force signal is converted to a 0–10 volt signal for use by controller 197. The pressure transducer 135 has a sensing element that converts pressure into analog signals which are acceptable to the program of controller 197. When counter rotating packerheads are used with cores 39 and 42, the power used to turn the upper roller units is sensed to provide signals used by the computer controller to control operation of the conveyors and lift speed of the cores to make concrete pipes. Pump 128 is wired to a pump driver board 132 which operates to control the fluid output of pump 128.

As shown in FIGS. 5B and 5C conveyors indicated generally at 133 and 134 operable to supply molds 27 and 28 with concrete that is formed into concrete pipes. Conveyor 133 has an elongated endless belt 136 trained over a drive roller 137 for delivering a stream of concrete 138 into the mold chamber above packerhead 141. Conveyor 133 is located below a hopper 139 that stores a supply of concrete 141. A hydraulic motor 142 driveably coupled to drive roller 137 to operate conveyor belt 136. Motor 142 is coupled to a pump 143 with a line 144. A return line 146 delivers the hydraulic fluid from motor 142 to a pump 147. Interposed in lines 144 and 146 is a proportional valve 148 operable to control the supply or hydraulic to motor 142 and reverse the operation of motor 142. Valve 148 is wired to a valve driver board 149 whereby valve 148 is controlled in response to command signals from the computer controller. Valve driver board 149 is also wired to a linear variable differential transformer 151 operable to sense the position of the spool of the valve and provide a signal to the valve driver board indicating this spool position.

Conveyor 134 has an endless belt 152 trained over a drive roller 153 to deliver a ribbon or concrete 154 into mold 28 above packerhead 108. A hopper 156 associated with conveyor 134 carries a supply of concrete above conveyor 134. A hydraulic motor 158 is driveably connected to drive roller 153 to move belt 152 thereby discharge concrete into mold 28. Hydraulic fluid under pressure is delivered to motor 158 from a pump 159 through a line 161. Return line 162 carries the fluid from hydraulic motor 158 back to a sump 163. A proportional valve 164 is interposed in lines 161 and 162 for controlling the flow of fluid to motor 158 and thereby controlling the speed of conveyor 134. The solenoids of valve 164 are wired to a valve driver board 166 operable to control the position of the spool of valve 164 and thereby control the rate and direction of the flow of hydraulic fluid to motor 158 thereby control the speed of conveyor 134. Valve 164 is equipped with a linear variable differential tranducer 167 that is wired to valve driver board 166. Transducer 167 monitors the position of the spool of valve 164 so that the command signal to the valve driver board 166 from the computer controller 197 correctly positions the spool of valve 164 so that the flow of hydraulic fluid through valve 164 corresponds to the command signal. The operating speeds of conveyors 133 and 134 and lift speed of packerhead and core assemblies are correlated by controller 197 to overcome excessive overpack and underpack conditions to ensure substantially uniform concrete compaction and density throughout the length of the concrete pipes.

Machine 10 is equipped with a water injection system for adding water to the concrete as it is discharged into molds 27 and 28. As shown in FIGS. 5B and 5C, nozzles 168 and 169 located above top table 31 discharges water into molds 27 and 28 where it mixes with the concrete above roller heads 41 and 108 respectively. The nozzles 168 and 169 are connected to a supply of water 171 with pipes 172 and 177. An on-off valve 173 is located in pipe 172 adjacent a flow control valve 174. Valve 174 is wired to a proportional valve driver 176 that responds to command signals from computer controller 197 to operate valve 174. An on-off valve 178 controls the flow of water to control valve 174.

The moisture content of the concrete in hopper 139 is sensed with a moisture senser 182 located in the concrete 141. Moisture sensor 142 is wired to computer controller 197 which utilizes an input signal from sensor 182 to develop a command signal to proportional valve driver 176 to operate flow control valve 174 so that a programmed amount of water can be discharged through nozzle 168 into mold 27. A second moisture sensor 183 is located in the concrete 157 in hopper 156. Sensor 183 is wired to computer controller 197 which receives signals from the sensor 183 as to the moisture content of concrete 157 and establishes a command signal for proportional valve driver 181 to operate the flow control valve 179 and thereby discharged a programmed amount of water into mold 78 which mixes with the concrete in mold 28.

A pump 184 delivers hydraulic fluid under pressure to the platform lift cylinders 55 and 56. A return line carries fluid from cylinders 55 and 56 back to sump 185. A proportional valve 188 is connected to lines 186 and 187 for controlling the rate of flow and direction of the flow of hydraulic fluid to the lift cylinders 55 and 56 and thereby control the movement of platform 44 in up and down directions to move the cores 39 and 42 into and out of the mold 27 and 28 respectively. The solenoids of valve 188 are wired to a proportional valve driver board 189 operable to control the position of the spool of the valve thereby control the flow of fluid through valve 188. A linear variable differential transducer 191 coupled to valve 188 is also wired to valve driver board 189. Transducer 191 senses the position of the spool of 188 and signals this position to valve driver board 189. The valve driver board 189 on command signal from the computer controller 197 corrects the position of the valve spool to correspond to the flow value indicated by the command signal.

Platform 44 is also equipped with a position sensor 192 that provides information as to locations of cores 27 and 28 relative to molds 39 and 42. The signal from sensor 192 is fed to computer controller 197 for use in operation of the machine.

Hoppers 139 and 156 are provided with concrete levels sensors 193 and 194. The level sensors 193 and 194 generate signals when the level of the concrete in either hopper 139 or 156 is below a preselected level so that the hoppers do not run empty.

The programmable computer controller, indicated generally at 196 in FIG. 5A, controls the functions of the machine including the operations of cores 39 and 42, packerheads 41 and 108 and conveyors 133 and 134 during the pipe making process. Electrical conductors or lines 204–221 as shown in FIGS. 5A, 5B and 5C couple computer controller 197 to the core, roller head, conveyor and water controls and sensor of the machine. The controller 197 is also coupled to other machine controls and functions indicated 198 and 199 and a secondary computer 201. Digital and analog variable adjustment devices and controls 202 provide input into computer controller 197. A modum 203 is also connected to controller 197 so that adjustments in the programs can be made at a remote location via telephone communications. An example of computer controller 197 is marketed by the Allen Bradley Company of Milwaukee, Wis., as in Allen Bradley PLC family controller. Other types and models of programmable computers can be used in control system 196 for machine 10.

Figure 6:
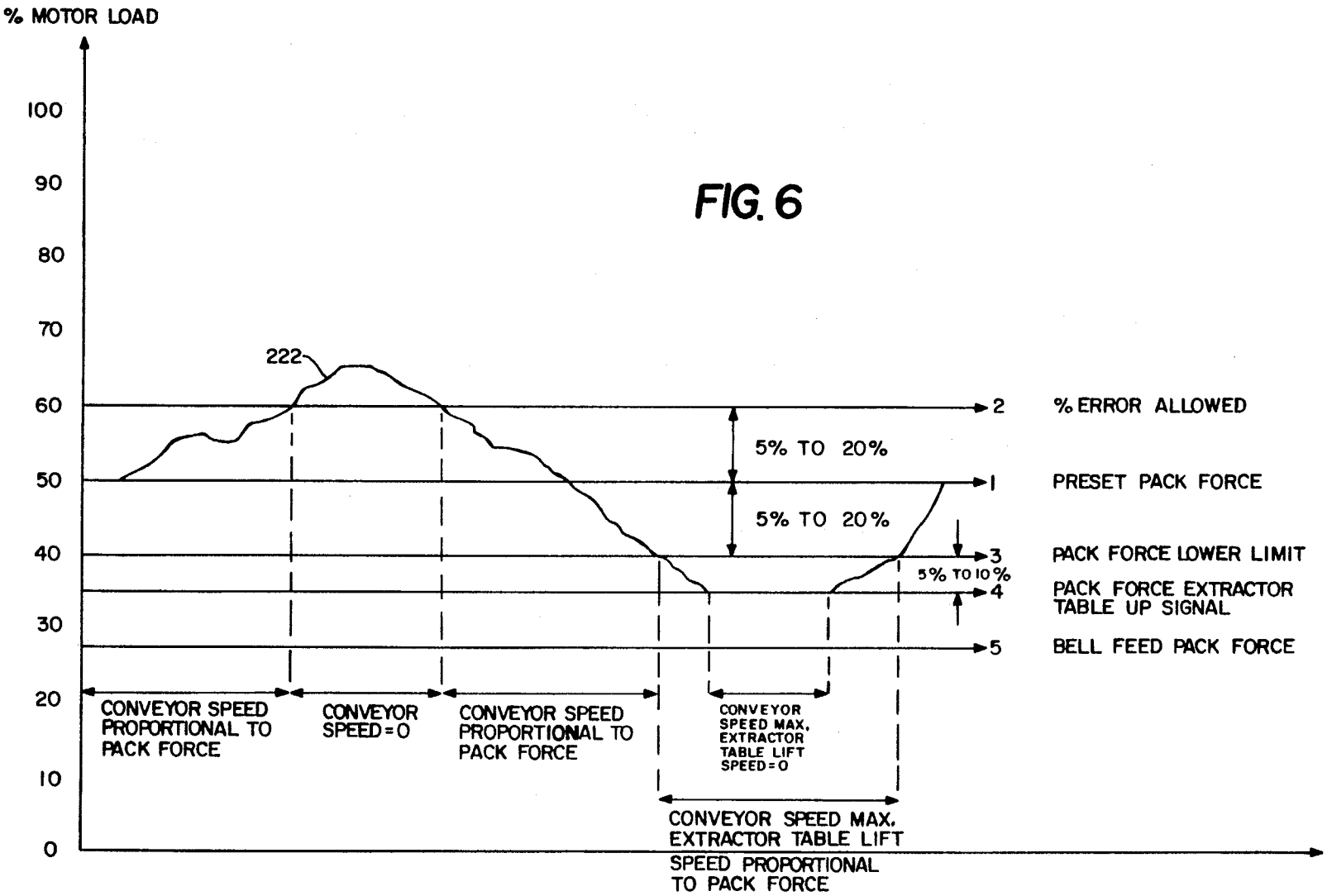
FIG. 6 is a graph showing an example concrete packing curve illustrating the different packing situations that can occur during the production of a concrete pipe with the machine of FIG. 1.

FIG. 6 is a graph showing an example packing curve 222 illustrating the different possible pack situations that can occur during the production of concrete pipe. The graph shows how the feed and lift controls react to different pack forces sensed by roller head 41. Line 1 is the preset pack force at which the concrete pipe is to be packed. This line is adjusted by presetting the preset pack force variable to the percentage pack required. Line 2 represents the line at which the conveyor feed speed reaches zero speed. Line 2 is adjusted by adjusting the percent error allowed variable. This adjustment is a percentage of the preset pack force, accordingly when the preset pack force variable is readjusted to a different value the processor will automatically calculate the new value of line 2. The percent error allowed should be between five and twenty percent. If the percent error allowed is adjusted less than five percent the conveyor speed will start to oscillate. On the other hand too high of an error allowed will allow overpacking of the concrete pipe. Accordingly, this value should be maintained as low as possible without allowing the conveyor feed speed to oscillate. Controller 197 will prevent automatically entering any values above or below these limits.

Controller 197 will keep the pack force between line 1 and line 2. The other variable needed for the feed control is the conveyor feed maximum speed. This is the maximum speed that the conveyor 133 can operate. The reason to limit the conveyor speed to a maximum speed is to prevent sudden high speeds that can occur with sudden underpacks. These high speeds drive the system into an oscillating mode. The packerhead lift speed control takes care of the situations when underpack occurs. The conveyor maximum speed is adjusted in a way that it is slightly faster than required to make a perfect pipe. When the actual pack force is at line 1 the conveyor feed speed is at maximum. When the pack force increases above line 1 controller 197 will decrease the speed of conveyor 133 proportionally to the pack force. These corrections are done until the conveyor speed reaches the ideal feed speed at which the pack force is maintained the same. Any small higher or lower fluctuation in the pack force will make computer controller 197 correct the speed of the conveyor feed speed. Since the conveyor speed is faster than needed to make pipe, the pack force is always above the preset pack force value of line 1. The formulas used for the conveyor feed control are as follows:

CONVEYOR SPEED=CONVEYOR MAXIMUM SPEED−SPEED CORRECTION VALUE SPEED CORRECTION VALUE=A GAIN

Where:

A=ACTUAL PACK FORCE−PRESET PACK FORCE

If A=NEGATIVE VALUE Then A=ZERO

If A is negative indicating that the actual pack force is lower than the preset pack force setting, then A is equalled to zero. Accordingly, the speed correction value will be zero and the conveyor feed speed will be running at the conveyor maximum speed setting.

Also the:

GAIN=CONVEYOR MAXIMUM SPEED/PERCENT ERROR ALLOWED

This equation automatically calculated the gain so that any changes in the conveyor maximum speed preset will change the gain. An increase or decrease in the conveyor maximum speed setting will increase or decrease the gain respectively leading to a higher or lower speed correction value for the same amount of error. That means that the actual pack force reaches line 2 for any setting of the conveyor maximum speed. This formula eliminates the need for a sensitivity adjustment.

In the case when the speed correction value is larger than the conveyor maximum speed due to a very large error the conveyor speed equation becomes negative. The following logic is used to prevent conveyor 133 from running in the reverse direction.

If CONVEYOR SPEED=NEGATIVE Then CONVEYOR SPEED=ZERO

Line 3 is the pack force lower limit and represents the line below which the extractor platform 44 lift speed control is energized. As long as the actual pack force is above line 3 the extractor platform lift speed remains at its preset value. Once the actual pack force reaches this line and starts to fall below it, the extractor platform lift speed will start to decrease proportionally to the actual pack force until the extractor platform lift speed comes to a stop. Line 3 is adjusted by adjusting the percent pack below variable. This adjustment is also a percentage of the preset pack force so that any change in the preset pack force will automatically be followed by an adjustment of the pack force lower limit. The percent pack force below should be between five and twenty percent. Computer controller 197 will not allow a value larger or smaller than these limits from being entered. The other variables needed for the extractor platform lift speed control are the extractor platform preset lift speed and the pack force extractor platform up signal. The extractor platform preset lift speed is the speed with which the platform travels when the actual pack force is within the normal limits. The pack force extractor platform up signal line 4 is the line below which the extractor platform lift speed is equal to zero. This line is usually the pack force below which the pipe quality is affected. Line 4 must be within five percent to maximum ten percent below the pack force lower limit line 3. A value less than five percent will make the extractor platform speed oscillate and a larger value than ten percent will affect the quality of the pipe. Computer controller 197 will prevent any values below or above these limits from being entered.

When an underpack situation arises and the actual packing force is lower than the pack force lower limit, the extractor platform lift speed control is energized and the extractor platform lift speed is slowed down and will eventually come to a complete stop when the actual pack force is at or lower than the pack force extractor platform up signal line 4.

Machine 10 being designed to produce one or two pipes per cycle, requires special equations to handle the two pipes per cycle production. In this case the controls monitor and calculate the lift speed of the core and packerhead assemblies for each of the two pipes being produced, and because the extractor platform 44 carries vibrating cores 39 and 42 of both pipes the controls will use the extractor platform lowest speed of the pipe that is underpacking. As for the other pipe that is packing normally, when the extractor platform lift speed slows down, the pack force will start to increase and the conveyor speed control will accordingly reduce the feed speed to compensate for the lower extractor table lift speed. The equations that are used to control this part of the packing curves are as follows:

EXTRACTOR TABLE LIFT SPEED=EXTRACTOR TABLE PRESET LIFT SPEED−SPEED CORRECTION VALUE the speed correction value is determined from the following two equations:

| | |
|---|---|
| If | SPEED CORRECTION VALUE GREATER THAN SPEED CORRECTION VALUE |
| Then | SPEED CORRECTION VALUE = SPEED CORRECTION VALUE |
| If | SPEED CORRECTION VALUE IS LESS THAN SPEED CORRECTION VALUE |
| Then | SPEED CORRECTION VALUE = SPEED CORRECTION VALUE |

These equations determine which speed correction value is used. When the speed correction value of the first pipe is larger, indicating that it is underpacking more than the second pipe then controller 197 will select this higher correction value. On the other hand when the second pipe is underpacking more than the first pipe, the controller 197 will select the speed correction value of the second pipe.

The speed correction values are calculated as follow:

SPEED CORRECTION VALUE FIRST PIPE=B1 GAIN 1

SPEED CORRECTION VALUE SECOND PIPE=B2 GAIN 2

Where:

B1=PACK FORCE LOWER LIMIT FIRST PIPE−ACTUAL PACK FORCE FIRST PIPE

If B1=NEGATIVE VALUE Then B1=ZERO and:

B2=PACK FORCE LOWER LIMIT SECOND PIPE−ACTUAL PACK FORCE SECOND PIPE

If B2=NEGATIVE VALUE Then B2=ZERO

If B for either pipe is negative indicating that the actual pack force is above the pack force lower limit line 3, then b is equalled to zero, accordingly the speed correction value will be zero.

also the:

| | |
|---|---|
| GAIN 1 = | EXTRACTOR TABLE PRESET LIFT SPEED / PACK FORCE LOWER LIMIT FIRST PIPE − PACK FORCE EXTRACTOR TABLE UP SIGNAL FIRST PIPE |
| GAIN 2 = | EXTRACTOR TABLE PRESET LIFT SPEED / PACK FORCE LOWER LIMIT SECOND PIPE − PACK FORCE EXTRACTOR TABLE UP SIGNAL SECOND PIPE |

These two equations automatically calculates the gain for both pipes so that the extractor platform lift speed will reach zero when the actual pack force is at or lower than the pack force extractor platform up signal line 4. It eliminates the need for a sensitivity adjustment, because any increase or decrease in the extractor platform preset lift speed will respectively increase or decrease the gain and accordingly the extractor platform lift speed will always reach its minimum value of zero when the actual pack force is at or below the pack force lower limit.

In equation for the extractor platform lift speed if the extractor platform lift speed is negative due to a very large error, then to prevent the extractor platform 44 from moving in the opposite direction, the following logic is used:

If EXTRACTOR TABLE LIFT
SPEED=NEGATIVE VALUE Then
EXTRACTOR TABLE LIFT SPEED=ZERO FIGS. 5A, 5B, and 5C show the configurations of the controls for machine 10. Power transducer 131 of station 1 is wired to the packerhead driving motor 129. Power transducer 100 of station 2 is wired to packerhead driving motor 97. These two power transducers 131 and 100 sense the true power reading of the electric motors 129 and 103. The power transducers 131 and 100 convert these readings into a 0 to 10 volt analog signals proportional to the power of the motors. Power transducers 131 and 100 are wired to an analog to digital converter inputs in the programmable computer controller 197. The converter translates the analog signals into digital values. The converter also has a scaling factor which scales the results into digital values representing the power as a percentage values of 0 to 100 percent of the maximum motor power ratings. Pressure transducers 110 and 140 can be used in lieu of transducers 100 and 131 to provide 0 to 10 analog signals proportional to the packing force of packerheads 41 and 100.

The digital and analog variables adjustment devices and controls 202 include all the different potentimeters, digital thumbwheels and digital keypads than are used to adjust all the variables that are required by the conveyor feed control, the extractor platform lift speed control and all the other controls of the machine. These devices and controls 202 are of the digital and the analog type. The analog devices and controls are wired to the analog to digital converter inputs of the programmable computer controller 197. The converter converts and scales these values to percentages. The digital devices and controls are wired to the digital inputs of the programmable computer controller 197 are usually entered in percentages values.

The computer controller 197 continuously monitor the actual pack force and continuously calculate the proper conveyors speed for both stations #1 and #2 and the proper extractor platform lift speed.

The conveyor speeds values are continuously sent to a digital to analog converter in the programmable computer controller 197 that converts and scales the digital values of the two speeds into analog values from 0 to 10 volts representing 0 to 100 per cent of the conveyor speeds. The signal for station #1 is wired to the proportional valve driver board 166 for station #1. The signal for station #2 is wired to the proportional valve driver board 149 for station #2. The conveyor speeds are changed by using the proportional valves 164 and 148 for stations 1 and 2 respectively. Each driver board of the proportional valves will send a signal to the forward coil of their corresponding valves proportionally to its input signal from the controller 197. To obtain the same flow for the same input signal, linear differential variable transducers 167 and 151 are used on valves 164 and 148 to sense the positions of the spools and feedback signals are sent to the driver boards to monitor the spool positions and always repositioning it in the proper position to have the correct fluid flows.

In the case that conveyor 134 for station #1 is to be turned in reverse to empty hopper 156 or conveyor 133 for station #2 is to be turned in reverse to empty hopper 139, a negative signal is generated from programmable computer controller 197 to the corresponding conveyor proportional driver boards 166 and 149 which send a signal to the reverse coil of the corresponding proportional valve 164 and 148.

The extractor platform lift speed value is continuously sent to the analog to digital converter which converts and scales the extractor platform lift speed to an analog signal 0 to 10 volts representing 0 to 100 percent of the extractor table lift speed. This signal is sent to the proportional valve driver board 189. The packer head and core lift speed is changed by using proportional valve 188. The driver board 189 of the proportional valve 188 will send a signal to the up coil of the valve proportionally to its unput signal from controller 197. To obtain the same flow for the same input signal a linear variable differential transducer 191 is used on valve 188 to sense the position of the spool and a feedback signal is sent to the driver board 189 to monitor the spool position and always repositioning it in the power position to have the correct flow. Programmable computer controller 197 sends a negative signal to the proportional valve driver board 189 which sends a signal to the down coil of the valve 188 to lower the platform 44.

The molds 27 and 28 containing concrete pipes are removed from turntable 21 after the turntable 21 has been rotated to located the molds in the off bearing position. A second pair of molds are located in vertical alignment with cores 39 and 107 whereby the machine can run another cycle to make a second pair of concrete pipes.

While there is shown and described a machine for concurrently making a pair of concrete pipes, it is understood that changes in materials, parts, and combinations of structures can be made by one skilled in the art without changing the invention. The invention is defined in the following claims.

I claim:

1. A machine for concurrently making a pair of concrete pipes with the use of upright first and second molds having side walls surrounding mold chambers comprising: a support for holding the molds in vertically oriented positions, a first core and rotatable packerhead means located below said support in vertical alignment with the chamber of the first mold; a second core and rotatable packerhead means located below said support in vertical alignment with the chamber of the second mold; table means supporting said first and second core and packerhead means for concurrent movement into the mold chambers to form concrete pipes, first conveyor means located above the first mold for discharging concrete into the mold chamber of the first mold above the first core and rotatable packerhead means, first motor means connected to the first conveyor means for operating the first conveyor means, second conveyor means located above the second mold for discharging concrete into the mold chamber of the second mold above the second core and rotatable packerhead means, second motor means connected to the second conveyor means for operating the second conveyor means; said first and second core and rotatable packerhead means each having an upright core having a top wall and a side wall spaced from the adjacent mold to provide an annular space for accommodating concrete, vibrator means mounted on the side wall for vibrating the side wall and concrete adjacent thereto, a packerhead located above the top wall operable to distribute concrete toward said adjacent mold side wall and prepack concrete around the packerhead, means mounting the packerhead on the core for rotation about the upright axis of the core, and drive means located within the core for rotating the packerhead; power means connected to the table means operable to concurrently move the first and second core and packerhead means into the chambers of the first and second molds to concurrently form concrete pipes within the first and second molds upon operation of the first and second conveyor means and vibrator means whereby the packerheads prepack the concrete around the side walls of the molds and the cores vibrate to consolidate the prepacked concrete, said power means operable to move the first and second core and packerhead means out of the mold chambers to allow the molds and concrete pipes therein to be removed from the machine; first means for sensing the power used to turn the first packerhead and providing a first signal representative of the sensed power; second means for sensing the power used to turn the second packerhead and providing a second signal representative of the sensed power; control means responsive to said first and second signals for separately controlling the speeds of operation of the first and second motor means to independently operate the first and second conveyor means to independently maintain selected amounts of concrete above the first and second packerheads whereby each packerhead has substantially constant and independent packing forces during the concurrent forming of the concrete pipes, means for directing water into the first and second molds, sensor means for monitoring moisture content of concrete discharge by the first and second conveyors into the first and second molds, said sensor means providing a signal representative of the moisture content of the concrete, means for operation of the means for directing water into the first and second molds, and control means responsive to the signal for regulating the means for directing water into the first and second molds whereby the moisture content of the concrete in the first and second molds is maintained within selected limits.

2. The machine of claim 1 including: control means responsive to the first and second signals for operating the power means to move the table means and first and second core and packerhead means mounted thereon up into the mold chambers.

3. The machine of claim 2 wherein: the control means is operable to move the table means at selected speeds in response to said first and second signals to maintain said packing forces of the packerheads during the forming of the concrete pipes.

4. The machine of claim 1 wherein: each core and rotatable packerhead means has a motor for turning the packerhead, means for supplying power to the motor whereby the motor operates to turn the packerhead, said first and second means for sensing power associated with the means for supplying power to provide said signals representative of the sensed power.

5. The machine of claim 4 wherein: the motor is a hydraulic fluid operated motor, said means for supplying power comprising a pump for supplying hydraulic fluid under pressure to said motor, and electric motor for driving the pump, said means for sensing the power comprising a power transducer for monitoring the electric power used by the electric motor used to drive the pump and providing said signal representative of the sensed power.

6. The machine of claim 4 wherein: the motor is a hydraulic fluid operated motor, said means for supplying power comprising a pump for supplying hydraulic fluid under pressure to said motor, and means to drive the pump, said means for sensing power comprising a pressure transducer for sensing the pressure of the hydraulic fluid supplied to the motor and providing said signal representative of the sensed power.

7. The machine of claim 1 wherein: the means for directing water into the first and second molds includes valve means for regulating the flow of water into the first and second molds, said control means including means for operating said valve means.

8. The machine of claim 7 wherein: the control means includes a computer controller programmed to control the valve means to maintain the moisture content of the concrete within selected limits.

9. The machine of claim 1 wherein: said vibrator means includes a motor for operating the vibrator means at selected speeds to vary the vibrations generated by the vibrator means, and control means connected to said motor operable to increase the speed of the vibrator means as the core moves into the chamber of the mold thereby increasing the vibrations as the core moves up into the chamber of the mold.

10. The machine of claim 1 wherein: each packerhead has an upper roller head and a lower roller head, and said drive means turns the upper and lower roller heads in opposite circumferential directions, said first and second means for sensing the power used to turn the packerheads operable to sense the power used to turn the upper roller head and provide a signal representative of the sensed power.

11. The machine of claim 1 wherein: each packerhead has a generally circular plate and a plurality of circumferentially arranged rollers rotatable mounted on the plate for rotation about separate axes generally parallel to said upright axis of the core side wall, said rollers each having outer circumferential portions that move along a circular path having a diameter smaller than the diameter of said core side wall whereby said rollers prepack the concrete adjacent the mold to a thickness greater than the thickness of the concrete in the space between the core side wall and mold side wall as the rollers move along said circular path.

12. A machine for concurrently making a pair of concrete pipes with the use of upright first and second molds having side walls surrounding mold chambers comprising: a support for holding the molds in vertically oriented positions, a first core and rotatable packerhead means located below said support in vertical alignment with the chamber of the first mold; a second core and rotatable packerhead means located below said support in vertical alignment with the chamber of the second mold; table means supporting said first and second core and packerhead means for concurrent movement into the mold chambers to form concrete pipes, each core and packerhead means having a core with a side wall and a top wall secured to the side wall, vibrator means for vibrating said core, a packerhead located above the top wall, means rotatably mounting the packerhead on the top wall for rotation about the upright axis of the core, drive means for rotating said packerhead; a pair of separate means for supplying concrete to the mold chambers above the packerheads located therein, first drive means for operating one means for supplying concrete to one mold chamber, second drive means for operating the other means for supplying concrete to another mold chamber; lift means connected to the table means to selectively move the first and second core and packerhead means into and out of the mold chambers to concurrently form a pair of concrete pipes when concrete is separately supplied to the mold chambers by the pair of separate means, means for sensing the power used by the drive means for rotating each packerhead and providing signals representative of the sensed power, control means responsive to said signals for separately regulating the operation of the first and second drive means to independently operate the pair of separate means for separately supplying concrete into the mold chambers and the lift speed of the lift means to maintain selected amounts of concrete above each packerhead whereby each packerhead has substantially constant and independent packing forces during the forming of a pair of concrete pipes in said molds, sensor means for monitoring moisture content of concrete supplied to the mold chambers above the packerheads, said sensor means providing a signal representative of the moisture content of the concrete, means for directing water into the mold chamber, and control means responsive to the signal for regulating the means for directing water into the mold chambers whereby the moisture content of the concrete in the mold chambers is maintained within selected limits.

13. The machine of claim 12 wherein: the control means is operable to move the table means at select speeds in response to said signals to maintain said packing forces of the packerheads during the forming of the concrete pipe.

14. The machine of claim 12 wherein: the drive means for rotating said packerhead includes a motor, means for supplying power to the motor whereby the motor operates to rotate the packerhead, said means for sensing power associated with the means for supplying power to said motor to provide said signals representative of the sensed power.

15. The machine of claim 14 wherein: the motor is a hydraulic fluid operated motor, said means for supplying power comprising a pump for supplying hydraulic fluid under pressure to said motor, and an electric motor for driving the pump, said means for sensing the power comprising a power transducer for monitoring the electric power used by the electric motor used to drive the pump and providing said signals representative of the sensed power.

16. The machine of claim 14 wherein: the motor is a hydraulic fluid operated motor, said means for supplying power comprising a pump for supplying hydraulic fluid under pressure to said motor, and means to drive the pump, said means for sensing power comprising a pressure transducer for sensing the pressure of the hydraulic fluid supplied to the motor and providing said signals representative of the sensed power.

17. The machine of claim 12 wherein: said vibrator means includes a motor for operating a vibrator means at selected speeds to vary the vibrations generated by the vibrator means, and control means connected to said motor operable to increase the speed of the vibrator means as the core moves into the mold chamber thereby increasing the vibrations as the core moves up into the mold chamber.

18. The machine of claim 12 wherein: each packerhead has an upper roller head and a lower roller head, and said drive means turns the upper and lower roller heads in opposite circumferential directions, said first and second means for sensing the power used to turn the packerhead operable to sense the power used to turn the upper roller head and provide a signal representative of the sensed power.

19. The machine of claim 12 wherein: each packerhead has a generally circular plate and a plurality of circumferentially arranged rollers rotatable mounted on the plate for rotation about separate axes generally parallel to said upright axis of the core side wall, said rollers each having outer circumferential portions that move along a circular path having a diameter smaller than the diameter of said core side wall whereby said rollers prepack the concrete adjacent the mold to a thickness greater than the thickness of the concrete in the space between the core side wall and mold side wall as the rollers move along said circular path.

20. The machine of claim 12 wherein: the means for directing water into the mold chambers includes valve means for regulating the flow of water into the mold chambers, said control means including means for operating said valve means.

21. The machine of claim 20 wherein: the control means includes a computer controller programmed to control the valve means to maintain the moisture content of the concrete within selected limits.

22. A machine for concurrently making a plurality of concrete pipes with use of vertically oriented mold means having side walls surrounding mold chambers, comprising: a support for holding the mold means in vertically oriented positions, a plurality of packerhead and core assemblies located below said support in vertical alignment with the mold chambers of the mold means, table means supporting the plurality of packerhead and core assemblies for concurrent movement into the mold chambers to form a plurality of concrete pipes, each packerhead and core assembly having a core with a side wall and a top wall secured to the side wall, means for vibrating said core, a packerhead located above the top wall, means rotatably mounting the packerhead on the top wall for rotation about the upright axis of the core, drive means for rotating said packerhead, a plurality of separate means for supplying concrete to the mold chambers above the packerheads located therein, separate drive means for each means for supplying concrete to the mold chambers, lift means connected to the table means to selectively move the plurality of packerhead and core assemblies concurrently into and out of the mold chambers to concurrently form a plurality of concrete pipes when concrete is supplied to the mold chambers by the plurality of separate means, means for sensing the power used by the drive means for rotating each packerhead and providing signals representative of the sensed power, control means responsive to said signals separately for regulating the operation of each drive means to independently operate the plurality of separate means for supplying concrete into the mold chambers and the lift speed of the lift means to maintain selected amounts of concrete above each packerhead whereby the packerheads have substantially constant and independent packing forces during the forming of the plurality of concrete pipes in said mold means, sensor means for monitoring moisture content of concrete supplied to the mold chambers above the packerheads, said sensor means providing a signal representative of the moisture content of the concrete, means for directing water into the mold chambers, and control means responsive to the signal for regulating the means for directing water into the mold chambers whereby the moisture content of the concrete in the mold chambers is maintained within selected limits.

23. The machine of claim 22 wherein: the control means is operable to move the table means at select speeds in response to said signals to maintain said packing forces of the packerheads during the forming of the concrete pipe.

24. The machine of claim 22 wherein: the drive means for rotating said packerhead includes a motor, means for supplying power to the motor whereby the motor operates to rotate the packerhead, said means for sensing power associated with the means for supplying power to said motor to provide said signals representative of the sensed power.

25. The machine of claim 24 wherein: the motor is a hydraulic fluid operated motor, said means for supplying power comprising a pump for supplying hydraulic fluid under pressure to said motor, and an electric motor for driving the pump, said means for sensing the power comprising a power transducer for monitoring the electric power used by the electric motor used to drive the pump and providing said signals representative of the sensed power.

26. The machine of claim 24 wherein: the motor is a hydraulic fluid operated motor, said means for supplying power comprising a pump for supplying hydraulic fluid under pressure to said motor, and means to drive the pump, said means for sensing power comprising a pressure transducer for sensing the pressure of the hydraulic fluid supplied to the motor and providing said signals representative of the sensed power.

27. The machine of claim 22 wherein: said vibrator means includes a motor for operating a vibrator means at selected speeds to vary the vibrations generated by the vibrator means, and control means connected to said motor operable to increase the speed of the vibrator means as the core moves into the mold chamber thereby increasing the vibrations as the core moves up into the mold chamber.

28. The machine of claim 22 wherein: each packerhead has an upper roller head and a lower roller head, and said drive means turns the upper and lower roller heads in opposite circumferential directions, said first and second means for sensing the power used to turn the packerhead operable to sense the power used to turn the upper roller head and provide a signal representative of the sensed power.

29. The machine of claim 22 wherein: each packerhead has a generally circular plate and a plurality of circumferentially arranged rollers rotatable mounted on the plate for rotation about separate axes generally parallel to said upright axis of the core side wall, said rollers each having outer circumferential portions that move along a circular path having a diameter smaller than the diameter of said core side wall whereby said rollers prepack the concrete adjacent the mold to a thickness greater than the thickness of the concrete in the space between the core side wall and mold side wall as the rollers move along said circular path.

30. The machine of claim 22 wherein: the means for directing water into the mold chambers includes valve means for regulating the flow of water into the mold chambers, said control means including means for operating said valve means.

31. The machine of claim 30 wherein: the control means includes a computer controller programmed to control the valve means to maintain the moisture content of the concrete within selected limits.

* * * * *